US008672612B2

(12) United States Patent
Davis

(10) Patent No.: US 8,672,612 B2
(45) Date of Patent: Mar. 18, 2014

(54) PLATFORM COOLING OF TURBINE VANE

(75) Inventor: Anthony Davis, Bassingham (GB)

(73) Assignee: Siemens Aktiengesellschaft, Munich (DE)

( * ) Notice: Subject to any disclaimer, the term of this patent is extended or adjusted under 35 U.S.C. 154(b) by 834 days.

(21) Appl. No.: 12/597,278

(22) PCT Filed: Apr. 21, 2008

(86) PCT No.: PCT/EP2008/054783

§ 371 (c)(1),
(2), (4) Date: Oct. 23, 2009

(87) PCT Pub. No.: WO2008/132082

PCT Pub. Date: Nov. 6, 2008

(65) Prior Publication Data

US 2010/0129199 A1 May 27, 2010

(30) Foreign Application Priority Data

Apr. 27, 2007 (EP) ..... 07008697

(51) Int. Cl.
*F01D 9/02* (2006.01)
*F01D 25/12* (2006.01)

(52) U.S. Cl.
USPC ..... 415/115

(58) Field of Classification Search
USPC ..... 415/115–117
See application file for complete search history.

(56) References Cited

U.S. PATENT DOCUMENTS

| | | | | |
|---|---|---|---|---|
| 3,965,066 | A | 6/1976 | Sterman et al. | |
| 6,082,961 | A * | 7/2000 | Anderson et al. | 415/115 |
| 6,679,062 | B2 * | 1/2004 | Conete et al. | 60/796 |
| 6,758,651 | B2 * | 7/2004 | Tomita et al. | 415/115 |
| 7,857,580 | B1 * | 12/2010 | Liang | 415/115 |
| 2006/0123797 | A1 | 6/2006 | Zborovsky et al. | |

FOREIGN PATENT DOCUMENTS

| | | | |
|---|---|---|---|
| DE | 10 2005 013 795 | A1 | 9/2006 |
| EP | 0 616 111 | A1 | 9/1994 |
| EP | 0 902 164 | A1 | 3/1999 |
| EP | 1 741 877 | A1 | 1/2007 |
| WO | WO 2007/000409 | A1 | 1/2007 |

* cited by examiner

*Primary Examiner* — Edward Look
*Assistant Examiner* — Jesse Prager

(57) ABSTRACT

A turbine vane is provided which includes a radial outer platform, a radial inner platform and an airfoil extending between the outer platform and the inner platform. Each platform has a gas washed surface facing towards the respective other platform, a non gas washed surface facing away from the respective other platform and a peripheral surface extending from the gas washed surface to the non gas washed surface. The peripheral surface includes an upstream section that is designed to be directed towards the gas flow washing the gas washed surface. Cooling fluid channels each include an opening in the peripheral surface or in the gas washed surface and are located in at least a section of the outer platform and/or in at least a section of the inner platform. The respective section directly adjoins the upstream section of the peripheral surface of the respective platform.

5 Claims, 4 Drawing Sheets

PLATFORM COOLING OF TURBINE VANE

CROSS REFERENCE TO RELATED APPLICATIONS

This application is the US National Stage of International Application No. PCT/EP2008/054783, filed Apr. 21, 2008 and claims the benefit thereof. The International Application claims the benefits of European Patent Office application No. 07008697.0 EP filed Apr. 27, 2007, both of the applications are incorporated by reference erein in their entirety.

FIELD OF INVENTION

The present invention relates to a turbine vane comprising a radial outer platform, a radial inner platform and an airfoil extending between the outer platform and the inner platform.

BACKGROUND OF INVENTION

Turbine vanes are used for guiding the turbine's driving medium through the turbine so as to optimise momentum transfer from the driving medium to a rotor of the turbine. In gas turbines the driving mediums are hot and corrosive combustion gases. Therefore, the turbine vanes are usually coated with a thermal barrier coating system. However, in order to reduce gas turbine engines emissions and the specific power, one aims to achieve higher turbine entry temperatures of the combustion gas. This in turn means a higher thermal load on the turbine components, in particular on the turbine nozzle guide vanes, i.e. the first row of turbine vanes, which is facing the hot and corrosive combustion gas when it enters the turbine section of the gas turbine engine. The higher temperatures lead to increased corrosion of the nozzle guide vanes and, in particular, at the gas washed surfaces of the nozzle guide vanes' platforms.

To reduce the thermal load on the platform, the platforms are cooled by impingement cooling, i.e. by air jets directed onto their non gas washed surfaces. Such an impingement cooling is, e.g. disclosed in DE 10 2005 013 795 A1 or in WO 2007/000409 A1. Although impingement cooling has been sufficient with the current temperatures of the combustion gas entering the turbine section, it may be insufficient with future higher turbine entry temperatures of the combustion gas.

In EP 0 902 164 A1 is described another alternative for platform cooling. Thereby cooling fluid channels are located in the platform through a cooling fluid guide along the platform.

SUMMARY OF INVENTION

It is therefore an object of the present invention to provide a turbine vane with an improved cooling of the gas washed surface of one or both platforms.

This objective is solved by a turbine vane as claimed in the claims. The depending claims define further developments of the inventive turbine vane.

An inventive turbine vane comprises a radial outer platform, a radial inner platform and an airfoil portion extending between the outer platform and the inner platform, the outer platform and the inner platform each having a gas washed surface showing towards the respective other platform and a non gas washed surface showing away from the respective other platform. A peripheral surface extends from the gas washed surface of a platform to the non gas washed surface of the platform. The peripheral surface comprises an upstream section that is designed to be directed towards the gas flow washing the gas washed surface when the vane is fitted to a turbine. In the inventive turbine vane cooling fluid channels with an opening in the peripheral surface or in the gas washed surface are located in at least one section of the outer platform and/or in at least one section of the inner platform. The respective section directly adjoins the upstream section of the respective platform's peripheral surface.

By means of the cooling fluid channels it becomes possible to provide film cooling of the platform's gas washed surface. A cooling fluid, e.g. cooling air, is directed to the upstream section of the peripheral surface from where it can enter the flow space for the hot and corrosive combustion gases entering the turbine section. Due to the fluid properties of the hot and corrosive flow the cooling fluid becomes entrained so as to form the cooling fluid film on the gas washed surface of the platform. By means of such a film cooling, the cooling efficiency for the gas washed surface can be increased so that it can withstand higher temperatures of the combustion gas.

The cooling channels are slots which are present in the non gas washed surface of the outer platform and/or in the non gas washed surface of the inner platform in at least one section adjoining the upstream section of the respective platform's peripheral surface. The slots extend to the upstream section of the peripheral surface. The cooling fluid can then be led through the slots to the upstream section of the peripheral surface. This simple design can be realised by relatively low costs.

If the gap between the upstream section of the peripheral surface and a neighbouring element of the gas turbine engine is too small to allow for sufficient cooling fluid flow into the flow path of the combustion gas the slots may also extend through the upstream section of the peripheral surface. By this measure, the conduit that is present in the gap for the cooling fluid can be increased.

It is advantageous in view of a uniform cooling fluid film if a number of slots are present in the non gas washed surface and/or the upstream section of the peripheral wall of a platform where the slots are spaced from each other in the circumferential direction of the respective platform. The distribution of the slots can be adapted to the flow paths of the hot and corrosive combustion gas along the gas washed surface of a platform. However, if the flow paths are evenly distributed, it is advantageous if the slots are also evenly distributed over the non gas washed surface and/or the upstream section of the peripheral wall of the platform.

The inventive turbine vane, may in particular, be a nozzle guide vane.

BRIEF DESCRIPTION OF THE DRAWINGS

Further features, properties and advantages of the present invention will become clear from the following description of embodiments in conjunction with the accompanying drawings.

DETAILED DESCRIPTION OF INVENTION

Figure 1:
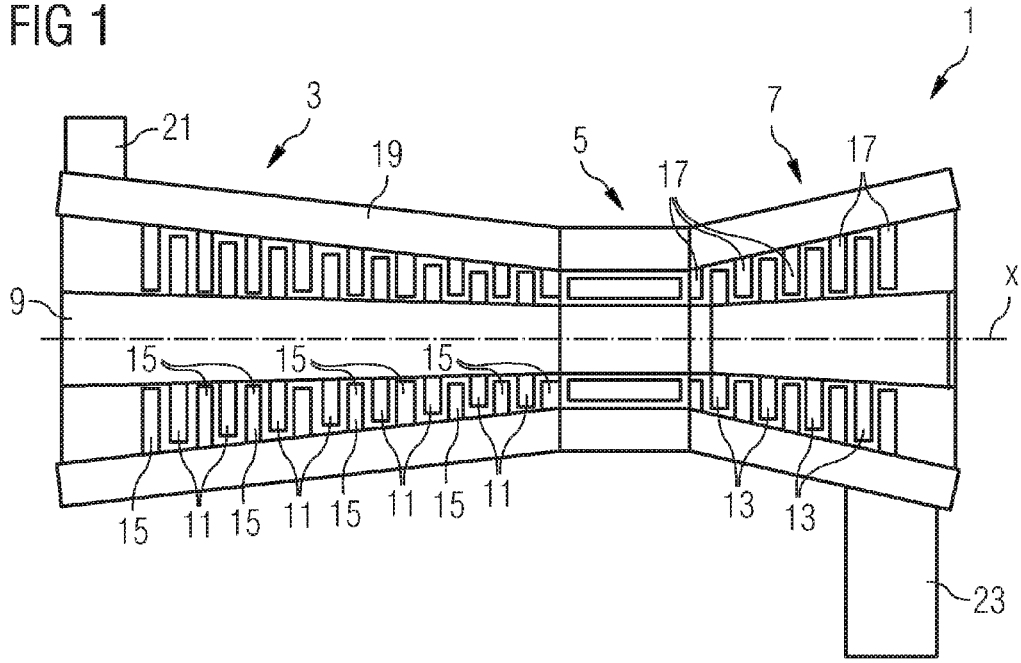
FIG. 1 shows a gas turbine engine in a highly schematic view.

FIG. 1 shows, in a highly schematic view, a gas turbine engine 1 comprising a compressor section 3, a combustor section 5 and a turbine section 7. A rotor 9 extends through all sections and carries, in the compressor section 3, rows of compressor blades 11 and, in the turbine section 7, rows of turbine blades 13. Between neighbouring rows of compressor blades 11 and between neighbouring rows of turbine blades 13 rows of compressor vanes 15 and turbine vanes 17, respectively, extend from a housing 19 of the gas turbine engine 1 radially inwards towards the rotor 9.

In operation of the gas turbine engine 1 air is taken in through an air inlet 21 of the compressor section 3. The air is compressed and led towards the combustor section 5 by the rotating compressor blades 11. In the combustor section 5 the air is mixed with a gaseous or liquid fuel and the mixture is burnt. The hot and pressurised combustion gas resulting from burning the fuel/air mixture is fed to the turbine section 7. On its way through the turbine section 7 the hot pressurised gas transfers momentum to the turbine blades 13 while expanding and cooling, thereby imparting a rotation movement to the rotor 9 that drives the compressor and a consumer, e.g. a generator for producing electrical power or an industrial machine. The expanded and cooled combustion gas leaves the turbine section 7 through an exhaust 23.

Figure 2:
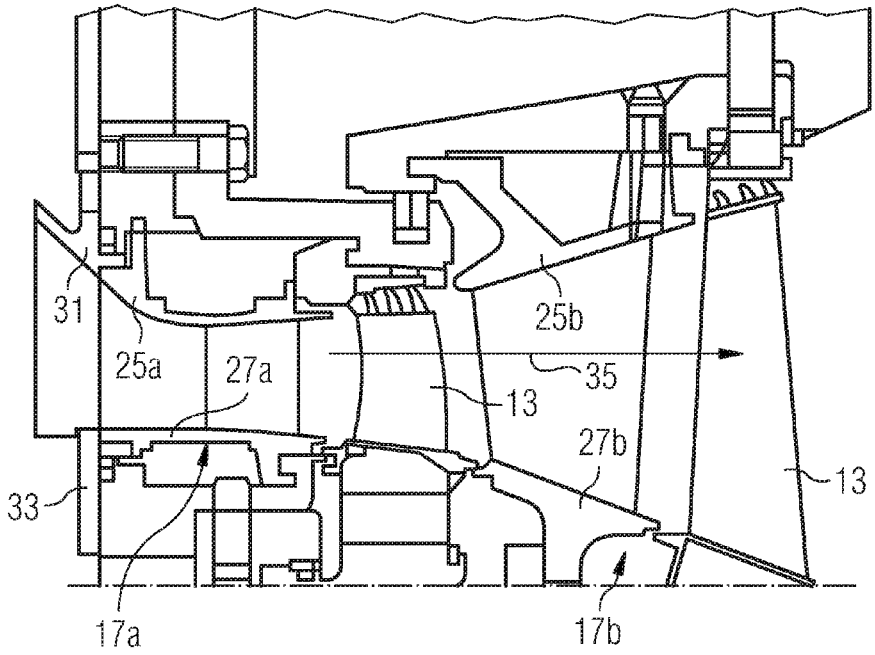
FIG. 2 shows the turbine entry of a gas turbine engine with two rows of guide vanes and two rows of turbine blades.

The entrance of the turbine section 7 is shown in more detail in FIG. 2. The figure shows two rows of turbine blades 13 and two rows of turbine vanes 17*a*, 17*b*. The turbine vanes 17*a*, 17*b* comprise radial outer platforms 25*a*, 25*b* and 27*a*, 27*b* that form walls of a flow path for the hot pressurised combustion gas together with neighbouring turbine components 31, 33 and with platforms of the turbine blades 13. The combustion gas flows through the flow path in the direction indicated in FIG. 2 by the arrow 35.

Figure 3:
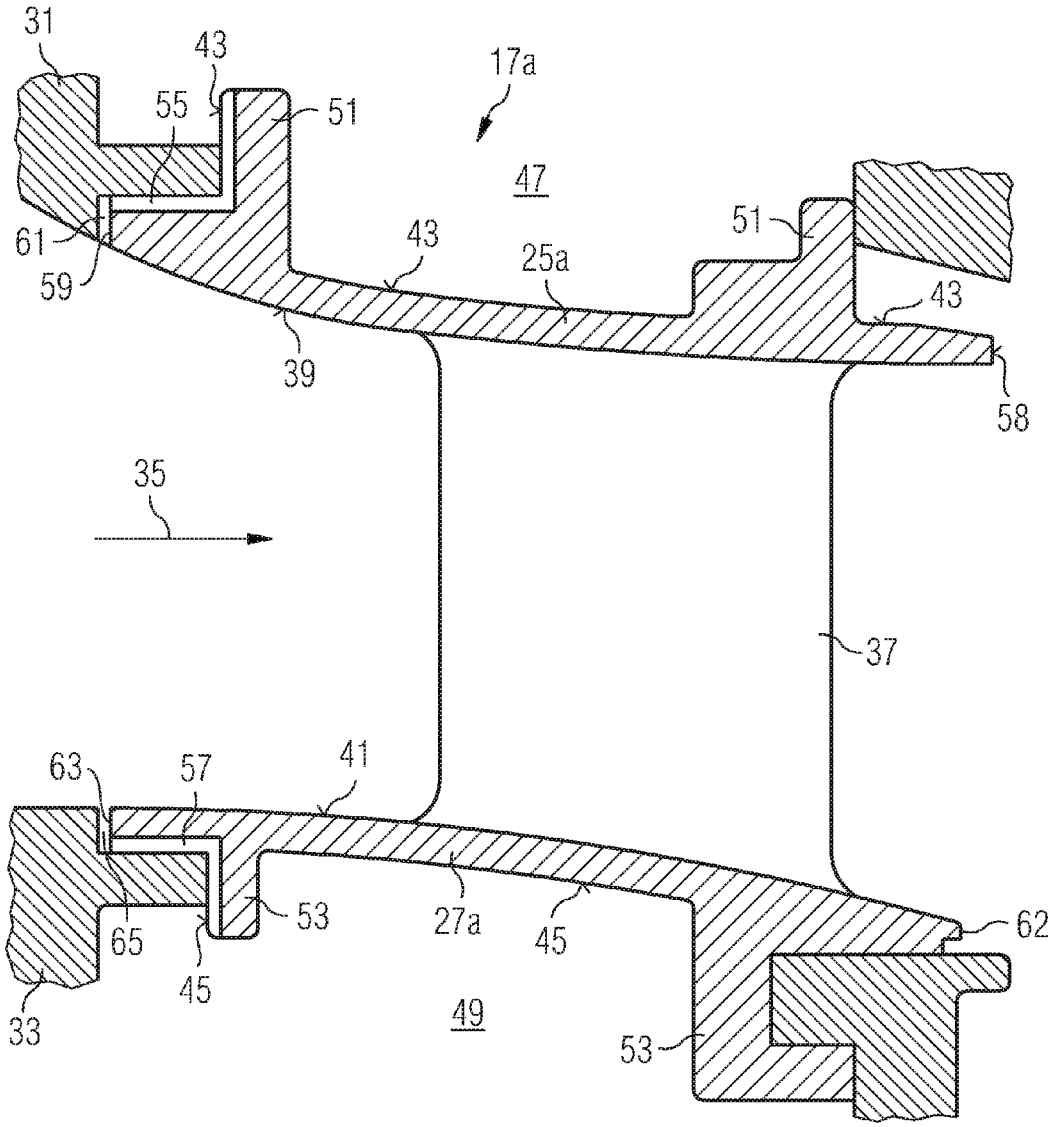
FIG. 3 shows an inventive nozzle guide vane in a sectional view.

A turbine vane 17*a* of the first row of turbine vanes is shown in more detail in FIG. 3. The figure shows a sectional view in a cut through the platforms 25*a*, 27*a* but not through the airfoil 37 of the vane 17*a*.

The airfoil 37 extends radially with respect to the turbine's rotor from the inner platform 27*a* to the outer platform 25*a*. It is usually hollow to allow a cooling fluid to flow through the vane. It may comprise film cooling openings (not shown) to discharge cooling fluid into the flow path of the combustion gas so as to provide film cooling for the surface of the airfoil 37.

Each platform comprises a gas washed surface 39, 41 which forms part of the wall of the flow channel for the combustion gas. The gas washed surfaces 39, 41 of the outer platform 25*a* and the inner platform 27*a* therefore face each other. Each platform further comprises a non gas washed surface 43, 45. The non gas washed surfaces form the opposite side of the respective platform so that the non gas washed surfaces of the inner and outer platform face away from each other. The non gas washed surfaces 43, 45 show towards cooling air supply chambers 47, 49 through which cooling air is supplied as a cooling fluid to the airfoil 37 and the non gas washed surfaces 43, 45 of the platforms 25*a*, 27*a*.

Figure 4:
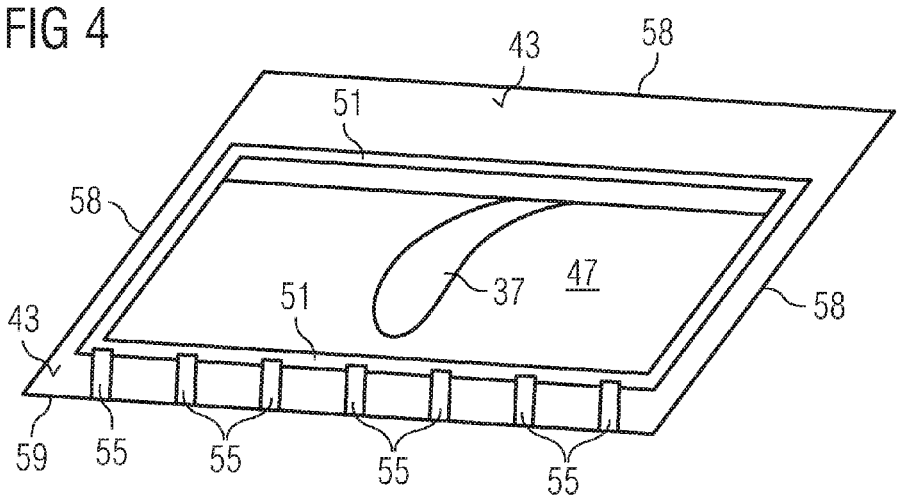
FIG. 4 shows the guide vane of FIG. 3 in a top view.

In the non gas washed surfaces 43, 45 fixing elements 51, 53 are present which are used to fix the turbine vane 17*a* to the casing 19 of the gas turbine engine. By fixing the turbine vane 17*a* to the casing 19 the turbine vane 17*a* is also fixed with respect to neighbouring turbine components, for example the turbine components 31, 33 neighbouring the turbine vane 17*a* on the upstream side. Usually a sealing contact is present between the turbine components 31, 33 and the respective platform 25*a*, 27*a*. Therefore, cooling air flow from the cooling air supply chambers 47, 49 to a gap 61 between the turbine component 31 and the radial outer platform 25*a* and to a gap 65 between the turbine component 33 and the radial inner platform 27*a* is rather small, if at all present. Therefore, slots 55 are cut into a section of the outer platform's non gas washed surface 43 that directly adjoins the upstream section 59 of the platform's peripheral surface 58. In the present embodiment of the invention the slots 55 are evenly distributed over the whole length of the non gas washed surface 43 that adjoins the upstream section 59 (see FIG. 4). These slots allow cooling air to flow into the gap 61 that is present between the upstream section 59 of the peripheral surface 58 and the surface of the neighbouring turbine component 31. The cooling air supplied through the slots 55 can then, through the gap 61, enter the flow path of the hot pressurised gas flowing through the turbine. The hot pressurised gas entrains the cooling air leaving the gap 61 towards the flow path of the combustion gas so that a cooling air film is formed above the gas washed surface 39 of the radial outer platform 25*a*. This cooling air film enhances the cooling of the gas washed surface 39 and thereby reduces oxidation and/or corrosion caused by the hot pressurised combustion gas. As a further cooling measure, the non gas washed surface 43 may be cooled by impingement cooling, as it is known from the state of the art.

Like the radial outer platform 25*a* the radial inner platform 27*a* is cooled by film cooling. To achieve film cooling of the gas washed surface 41 of the inner platform 27*a* slots 57 are cut into its non gas washed surface 45 in a section directly adjoining the upstream section 63 of the platform's peripheral surface 62. As described with respect to the upper platform 25*a*, cooling air can enter a gap 65 between the upstream section 63 of the peripheral surface 62 and the surface of the neighbouring turbine component 33. The cooling air can then enter the flow path of the combustion gas through this gap 65 and form a cooling air film over the gas washed surface 41 of the inner platform 27*a*. Like the outer platform 25*a*, the inner platform 27*a* may also be cooled by impingement cooling, as it is known from the state of the art.

Figure 5:
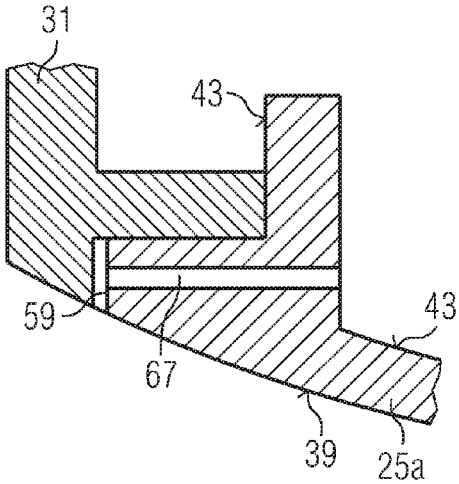
FIG. 5 shows a detail of a second embodiment of the inventive guide vane.
Figure 6:
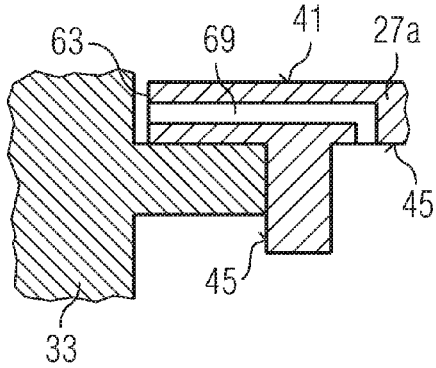
FIG. 6 shows another detail of the second embodiment.

A second embodiment of the inventive turbine vane will now be described with respect to FIGS. 5 and 6. While FIG. 5 shows a detail of the turbine vane's outer platform 25*a*, FIG. 6 shows a detail of the turbine vane's inner platform 27*a*. Also shown in these figures are parts of the neighbouring turbine components 31, 33. Elements of this embodiment which do not differ from the respective elements in the first embodiment are denoted with the same reference numerals as in FIGS. 3 and 4 and will not be described again to avoid repetition.

The second embodiment differs from the first embodiment in that no slots are present in the non gas washed surfaces 43, 45 of the radial outer platform 25*a* and the radial inner platform 27*a*, respectively. Instead, bores 67 are present in a section of the outer platform which adjoins the upstream section 59 of the outer platform's peripheral surface 58 and bores 69 are present in a section of the inner platform 27*a* which adjoins the upstream section 63 of the inner platform's peripheral surface 62. These bores form through holes extending from the non gas washed surface 43 of the outer platform 25*a* to the upstream section 59 of the outer platform's peripheral surface 58 and from the non gas washed surface 45 of the inner platform 27*a* to the upstream section 63 of the inner platform's peripheral surface 62, respectively. Hence, cooling air can be supplied through the bores 67, 69 into the gaps 61, 65 between the outer platform 25*a* and the neighbouring turbine component 31 and between the inner platform 27*a* and the neighbouring turbine component 33, respectively.

Figure 7:
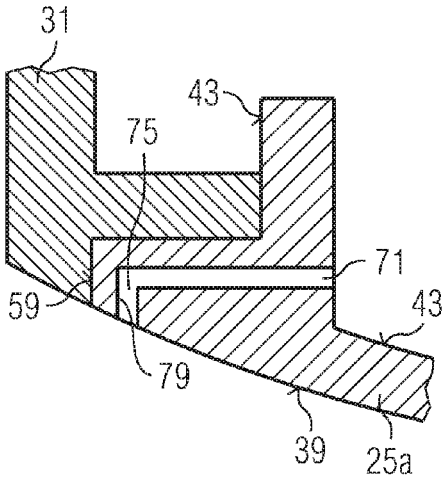
FIG. 7 shows a detail of a third embodiment of the inventive guide vane.
Figure 8:
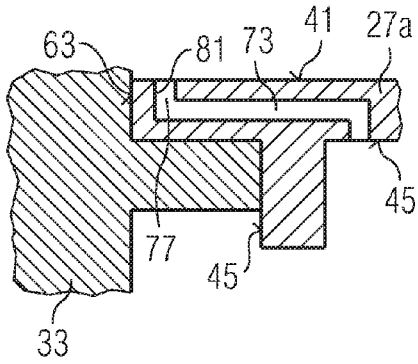
FIG. 8 shows another detail of the third embodiment.

A third embodiment of the inventive turbine vane will now be described with respect to FIGS. 7 and 8. While FIG. 7 shows a detail of the vane's outer platform 25*a*, FIG. 8 shows a detail of the vane's inner platform 27*a*. Elements that do not differ from the respective elements of the first embodiment are designated by the same reference numerals as in the first embodiment and will not be described again to avoid repetition.

FIG. 7 shows, in a sectional view, a part of the radial outer platform 25*a* of the vane 17*a* and a part of the neighbouring turbine component 31. FIG. 8 shows a part of the inner platform 27*a* of the turbine vane 17*a* and a part of the neighbouring turbine component 33. As in the second embodiment, bores 71, 73 are present in sections of the outer platform 25*a* and the inner platform 27*a* that adjoin the upstream sections 59, 63 of the respective platform's peripheral surface 58, 62. However, in contrast to the first and second embodiments, no gaps are present between the platform's upstream section 59, 63 and the respective neighbouring turbine component 31, 33. In this context, no gap means that no gap is present which allows a sufficient cooling air flow into the flow path of the hot pressurised combustion gas, such as to allow for film cooling of the gas washed surfaces 39, 41. Therefore, the bores 71, 73 in the third embodiment extend from the non gas washed surface 43 of the outer platform 25*a* to its gas washed surface 39 and from the non gas washed surface 45 of the inner platform to its gas washed surface 41, respectively.

The exits 75, 77 of the through holes formed by the respective bores, 71, 73 are open towards the flow channel through which the hot pressurised gas flows and are located as close as possible to the upstream sections 59, 63 of the peripheral walls 58, 62 so that areas not cooled by film cooling can be minimised. However, the remaining areas that are not film cooled in the outer platform's and the lower platform's gas washed surfaces 39, 41 can be cooled by impingement of the cooling air flow on the insides 79, 81 of the upstream sections of the peripheral surfaces 58, 62.

As an alternative to providing bores with openings in the gas washed surfaces it would be possible to extend the slots present in the first embodiment over the upstream section of the peripheral surface so as to provide channels extending from the non gas washed surface to the gas washed surface.

Like the slots in the first embodiment the bores in the second and third embodiments may be evenly distributed over the upstream section of the platform's peripheral surfaces.

The invention claimed is:

1. A turbine vane, comprising:

a radial outer platform;

a radial inner platform; and an airfoil extending between the outer platform and the inner platform, wherein each platform includes a gas washed surface facing towards a respective other platform, a non gas washed surface facing opposite to the gas washed surface and away from the respective other platform, and a peripheral surface extending from the gas washed surface to the non gas washed surface, wherein each peripheral surface includes an upstream section that is designed to be directed towards a gas flow washing the gas washed surface, wherein a plurality of cooling fluid channels, each including an opening in the peripheral surface, are located in a first section of the outer platform and/or in a second section of the inner platform, the respective section directly adjoining the upstream section of the peripheral surface of the respective platform, and wherein the plurality of cooling fluid channels are a plurality of slots located in the non gas washed surface of the outer platform and/or in the non gas washed surface of the inner platform in a third section adjoining the upstream section of the peripheral surface of the respective platform, wherein the non gas washed surface of the inner and/or outer platform, on which the plurality of slots are formed, shows toward and contacts a cooling air supply chamber through which cooling air is supplied to the airfoil and said non gas washed surface, wherein the plurality of slots are in contact with the cooling air supply chamber.

2. The turbine vane as claimed in claim 1, wherein the plurality of slots extend into or through the upstream section of the peripheral surface.

3. The turbine vane as claimed in claim 1, wherein the plurality of slots are located in the non gas washed surface and/or the upstream section of the peripheral surface of the respective platform, and wherein the plurality of slots are spaced from each other in a circumferential direction of the respective platform.

4. The turbine vane as claimed in claim 3, wherein the plurality of slots are equally distributed over the non gas washed surface and/or the upstream section of the peripheral surface of the respective platform.

5. The turbine vane as claimed in claim 1, wherein the turbine vane is a nozzle guide vane.

* * * * *